US008720494B2

(12) United States Patent
Combrink

(10) Patent No.: US 8,720,494 B2
(45) Date of Patent: May 13, 2014

(54) METHOD AND DEVICE FOR FILLING A PACKAGE

(75) Inventor: Alois Combrink, Oelde (DE)

(73) Assignee: Haver & Boecker OHG, Oelde (DE)

( * ) Notice: Subject to any disclaimer, the term of this patent is extended or adjusted under 35 U.S.C. 154(b) by 1017 days.

(21) Appl. No.: 12/042,696

(22) Filed: Mar. 5, 2008

(65) Prior Publication Data

US 2009/0272460 A1 Nov. 5, 2009

(30) Foreign Application Priority Data

Mar. 3, 2008 (DE) ..... 10 2008 012 218

(51) Int. Cl.

| | |
|---|---|
| ***B65B 1/04*** | (2006.01) |
| ***B65B 3/04*** | (2006.01) |
| ***B65B 1/08*** | (2006.01) |
| ***B65B 1/10*** | (2006.01) |
| ***B65B 3/18*** | (2006.01) |
| ***B65B 1/18*** | (2006.01) |
| ***B65B 1/24*** | (2006.01) |
| ***B65B 1/32*** | (2006.01) |

(52) U.S. Cl.

CPC ... *B65B 1/18* (2013.01); *B65B 1/04* (2013.01); *B65B 1/24* (2013.01); *B65B 1/32* (2013.01)

USPC ..... 141/10; 141/68; 141/73; 141/77; 141/95; 141/114; 141/313

(58) Field of Classification Search

CPC ..... B65B 1/04; B65B 1/18; B65B 1/24; B65B 1/32

USPC ..... 141/10, 68, 71, 73, 77, 94, 95, 114, 141/166, 313

See application file for complete search history.

(56) References Cited

U.S. PATENT DOCUMENTS

| | | | | | |
|---|---|---|---|---|---|
| 2,257,777 | A | * | 10/1941 | Anderson | 53/526 |
| 3,533,454 | A | * | 10/1970 | Tinsley | 141/10 |
| 3,568,733 | A | * | 3/1971 | Lau | 141/10 |
| 4,492,535 | A | * | 1/1985 | Stahlkopf | 417/394 |
| 5,170,609 | A | * | 12/1992 | Bullock et al. | 53/434 |
| 6,637,177 | B1 | * | 10/2003 | Trillich et al. | 53/434 |

FOREIGN PATENT DOCUMENTS

| | | |
|---|---|---|
| DE | 3703714 | 8/1988 |
| DE | 19541975 | 5/1997 |
| DE | 10 2006 057 176 A1 | 6/2008 |
| WO | PCT/EP2007/010252 | 11/2007 |
| WO | 2008/064847 A1 | 6/2008 |

* cited by examiner

*Primary Examiner* — Ryan Reis
(74) *Attorney, Agent, or Firm* — Pearne & Gordon LLP

(57) ABSTRACT

Method and apparatus for filling bags with loose materials, wherein a package to be filled is filled by means of a filling element in a filling process. The filling process comprises a filling stage, a settling stage, and a discharge stage wherein during the filling stage, loose material is filled into the bag while admitting air and in the settling stage, a settling phase is provided for the pressure to drop and in the discharge stage, the bag is discharged from the filling element. In the settling phase, the squeezing device applies a squeezing pressure to the package so as to vent the package and to reduce the volume available to the package, until a predetermined reduction of the volume available to the package is reached, whereupon the squeezing pressure of the squeezing device on the package is reduced and the package is discharged from the filling element.

20 Claims, 4 Drawing Sheets

Fig. 6
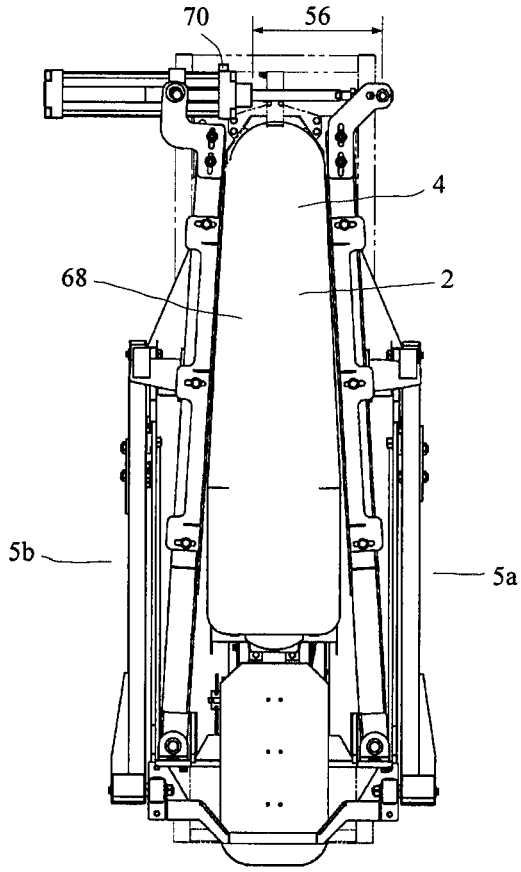
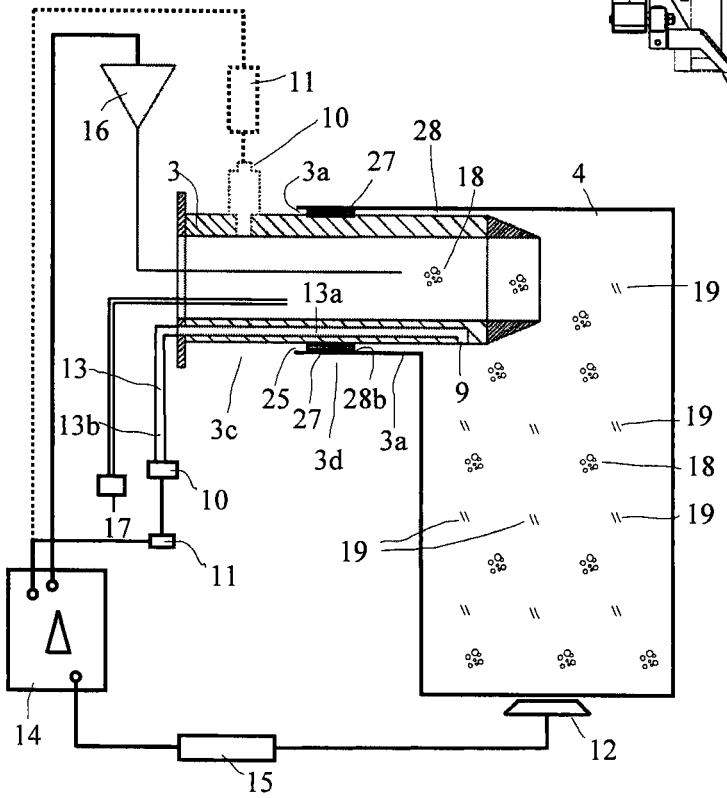
Fig. 7

METHOD AND DEVICE FOR FILLING A PACKAGE

BACKGROUND OF THE INVENTION

The present invention relates to a method and an apparatus for filling a flexible package, in particular a bag, with loose materials and in particular with bulk goods, wherein the flexible package is filled by means of a filling element. The invention serves to bag powdered or granular products and in particular to bag lightweight and very fine, powdered products such as aerosils, and carbon black particles employed in paint manufacture or $TiO_2$ particles or $TiO_2$-containing materials or the like where the bulk goods contain a considerable amount of air during filling. The invention is furthermore suitable for bagging other kinds of loose or free-flowing bulk materials or for bagging toxic or environmentally hazardous products.

Different systems for bagging bulk materials have become known in the prior art. In conventional systems for filling loose bulk goods into valved bags, the bulk goods include a certain air content during filling. The air content in the bag is allowed to gradually escape to the exterior through corresponding vents in the bag wall.

Still, excess pressure will exist in the bag during the filling process, for example approximately 150 to 250 millibars. Such excess pressure is still present as the filling element is cut off. Now when the bag is pulled off the filling element at the moment of cutting off, the pressure in the bag will be abruptly released through the valve, which is still open, so as to release to the exterior of the bag a certain quantity of material which in particular in the case of lightweight materials can be substantial. This will cause loss of bag weight and also contamination of the system and the bags. When bagging for example carbon black particles or $TiO_2$ particles, small quantities of escaped goods will already cause quite considerable contamination in the environment.

To reduce material escape and to improve the cleanliness of the installation and the bags, the prior art therefore provides that discharge of the bag is deferred until the pressure in the bag interior has dropped, or else the excess pressure needs to be released through a bypass. Pressure decrease through the walls in particular in the case of lightweight materials is very time-consuming such that a dramatic reduction of the bagging capacity must be expected. While releasing the pressure through a bypass accelerates the pressure decrease, material is not prevented from also escaping through the bypass which then results in weight loss of the bags. This may lead to substantial weight fluctuations. Also, escaped material must as a rule be discarded. On the whole, this condition will increase operating costs.

In the prior art, U.S. Pat. No. 3,533,454 has disclosed an apparatus for filling material into bags. During the filling operation the side faces of the bag are initially crushed in. During filling the side walls are then allowed to expand such that the filling material will not seal the pores in the side walls of the bag during the filling operation. The open pores are intended to provide continuous venting during filling. Such continuous venting may increase the filling rate in operation. This known method will only relatively slightly reduce the entire filling process because it is significantly determined by the maximum pressure in the bag at the end of filling and the subsequent waiting time after filling is terminated. Since the maximum pressure remains unchanged, the time required for the pressure decrease and thus the waiting time also remain unchanged.

In the prior art there was further disclosed in DE 195 41 975 A1, a method and an apparatus for forming and venting open bags after filling wherein the top edges of the bag wall overhangs are slidingly clamped in jaws and wherein after filling the clamping jaws are rolled in the direction of the bag filling level so as to allow the retained air to escape from the bag by means of a lance inserted in the bag through the upper feed inlet on which a vacuum can be applied. In this way the waiting time can be effectively reduced. One disadvantage of the known apparatus is, however, that the lance introduced into the bag does not only allow air but also filled material to escape.

DE 37 03 714 A1 discloses a bagging machine for bagging powdered goods by way of a filling spout which filling spout is provided with an air outlet equipped with a filter and connected with a vacuum source to draw the air out of the bag by suction. This apparatus may be used for filling powdered materials into valved bags. It is a disadvantage of the known apparatus, however, that when employing a coarse-pored filter, considerable quantities of filling material still escape through the outlet while when employing a fine-pored filter, the pores clog up rapidly and thus considerably reduce effectiveness.

These apparatus known from the prior art must thus, wherever material can escape from the bag with the air, provide for the bags to be overfilled by the expected amount of weight loss to reduce or compensate for weight fluctuations of the filled bags. Since such weight losses vary, weights will inevitably be largely scattered such that, in order to comply with minimum weights, more material must as a rule be bagged than is in fact required. Alternatively the settling time after the end of the filling operation may be extended for the excess pressure to drop.

In all of the cases described there is a disadvantage to the method by way of a noticeable cost increase, by clearly reduced capacities, and/or by loss of material and possibly contaminated bags.

There is furthermore described in the unpublished international patent application PCT/EP2007/010252, an apparatus and a method for filling bags with loose goods, wherein a package to be filled is filled through a filling element by means of a filling process. The filling process comprises a filling stage, a settling stage, and a discharge stage. During the filling stage, loose material is filled into the package; in the settling stage, a settling phase is provided for the pressure to decrease; and in the discharge stage, the package is discharged from the filling element. The filling process is shortened in that the volume available to the package during a considerable portion of the filling process, is reduced so as to maintain a high pressure inside the package, while at the end of the filling process, the available volume of the package is expanded to rapidly reduce the pressure prevailing in the package.

In view of the prior published state of the art it is the object of the present invention to provide a method and an apparatus which allow a rapid filling of flexible packages while at discharge there will be only slight or even virtually no loss of weight.

This object is solved by a method having the features of claim 1. The apparatus according to the invention is the object of claim 17. Preferred specific embodiments of the invention are the subjects of the subclaims. Further advantages and characteristics can be taken from the embodiment.

SUMMARY OF THE INVENTION

The method according to the invention is provided for filling flexible packages with loose materials and it serves preferably for filling bags in particular with lightweight loose materials. The package to be filled is filled through a filling element or through multiple filling elements by means of a filling process. The filling process comprises at least a filling stage, a settling stage, and a discharge stage. During the filling stage at least one loose material is filled into the package and in the settling stage at least one settling phase for venting is provided. In the discharge stage the package is discharged from the filling element. At least in the settling phase at least one squeezing device applies a squeezing pressure to the package for venting the package and reducing the volume available to the package. The squeezing pressure is applied long enough to achieve a predetermined reduction of the volume available to the package, whereupon the squeezing pressure of the squeezing device on the package is reduced and the package is discharged from the filling element.

At the end of the filling process, before discharge, the volume of the package and in particular the volume available to the package is preferably expanded so as to reduce the pressure prevailing in the package.

The term "filling process" in the sense of the present application is understood to mean the process from placement or disposing of the package until discharge or removal of the filled package. The filling process comprises in particular, presenting or placing the package, the actual filling operation of the package, and discharge of the filled package.

The term "filling operation" is understood to mean the process of filling, i.e. the filling stage, in which at least one phase of coarse filling and at least one phase of fine filling may be provided. The term "during the filling process" in the sense of the present application is understood to mean that the volume is generated in respect of time after starting the filling process, i.e. after presenting or placement and before discharge of the package.

One significant advantage of the invention is, the reduction of the volume in the settling phase until a predetermined reduction of the volume available to the package is achieved. In this way it is ensured that the internal pressure drops sufficiently to thus allow discharge without any material escaping. The predetermined reduction is preferably determined on the basis of empirical values for particular filling materials.

The expansion of the volume available to the package before discharge causes the pressure prevailing in the package to decrease directly proportional to the volume expansion, so as to directly achieve pressure decrease by way of the volume expansion since due to the increased internal pressure, the flexible package will immediately assume the expanded volume. Consequently the discharge pressure can be achieved rapidly such that no large loss of material will occur as the packages are discharged since the internal pressure of the package is reduced due to the expansion of volume.

Another advantage of the method according to the invention is an improved bag venting during the settling phase.

Loose material is preferably filled into the package during the filling stage while admitting air. Optionally the bag may be sealed after the filling process.

Also, the filling process is preferably shortened by way of reducing the available volume of the package during a substantial part of the filling process to maintain a high pressure in the package during filling. At the end of the filling process, the squeezing pressure is reduced and thus the available volume of the package is expanded so as to rapidly reduce the pressure in the package.

Basically a bag will start venting when excess internal pressure is present, i.e. when a pressure difference relative to the ambience is present. This moment typically occurs from approximately 50% of the weight to be filled. Due to the fact that in this more specific embodiment of the method, the volume available to the package is reduced early on, the pressure level in the bag during the filling operation will rise more steeply than in conventional methods so as to achieve at a considerably earlier time an excess pressure in the bag which sets off spontaneous venting of the bag. Since the venting rate of the package depends on the pressure difference between the bag interior and the environment, the excess pressure level prevailing during the filling stage will provide optimal venting. Venting of the package will be considerably accelerated.

When the pressure prevailing in the bag is plotted over time, the area beneath the curve represents a measure of the venting work. This surface area, being related to the duration of actual filling, is increased in the method according to the invention such that the invention can achieve more rapid filling.

Experience in a specific case has shown that excess pressure is building up in about half the time required otherwise, such that even as filling is in progress, effective venting occurs over a clearly longer period of time.

The volume is reduced near the end of the filling process in particular in the settling stage after terminating the filling operation, while the package is still placed on the filling spout or the filling element. For this purpose the venting pressure, which may already have been present, on the package is further increased and the squeezing pressure is set to reduce the available volume and thus the package volume, by venting the package.

In particular directly after cutting off the filling element, a high squeezing pressure which is in particular constant over time is applied to the package which leads to more intense venting of the package so as to reduce the package volume.

These measures are suitable to shorten the filling process and reduce the waiting time quite considerably. In a specific case, the duration of the settling phase was reduced from ca. 20 seconds to 5 seconds while the duration of the filling stage remained constant at approximately 30 seconds, such that the duration of the filling process was reduced by 20 to 30%.

Preferably at least one detector device is provided which, as the predetermined measure of the volume available to the package is achieved, reduces the squeezing pressure on the package. The detector device may be provided by way of a mechanical cam control or, in a preferred specific embodiment, configured as an electric detector device which emits a discharge signal.

For example, in a simple case the detector device may be configured as a limit switch. As the package volume is reduced as predetermined or a predetermined measure is reached, the limit switch is actuated such that said limit switch or a control device emits the discharge signal. Subsequently the discharge stage is initiated and finally the package is discharged.

Also it is possible to provide a plurality of limit switches or position switches, one of which can be selected to indicate the predetermined measure. What is also possible is an adjustable limit switch or position switch to allow to set the predetermined measure for example dependent on the material or else dependent on the package.

The detector device in particular captures a value approximately proportional to the volume available to the package. The detector device or an associated control device preferably emits a discharge signal as the value has arrived at the predetermined measure. Subsequently the squeezing pressure on the package is reduced and the package discharged.

In advantageous more specific embodiments the volume available to the package is reduced in the settling phase to a predetermined measure. This may be a fixed value and specified for all of the packages to be filled with a product.

Also it is possible that the volume available to the package is reduced in the settling phase by a predetermined measure. For example the width may be reduced, independently of the initial width which is dependent on the filled product and the bag dimensions, by e.g. 4 cm or 6 cm. This offers advantages in particular in the case of varying product characteristics.

Also it is possible to reduce the available volume by a specified or adjustable percentage.

In particular during at least part of the filling stage, an external venting pressure is applied to the package so as to already reduce the volume available to the package during filling and to assist with venting.

During the filling stage, a specified pressure is preferably rapidly built up in the package and subsequently roughly maintained. At the end of the settling stage, in particular after the settling phase, the volume may be greatly expanded in one step.

The available volume ensues during the filling stage substantially from a balancing of the internal package pressure against the venting pressure applied externally.

During the filling stage, a specified pressure is advantageously rapidly built up in the package and subsequently roughly maintained. The built-up pressure may be the maximally allowed pressure or a pressure specified in view of keeping within safety margins. The built-up venting pressure in particular lies beneath the filling pressure which the filling element can generate.

Although in all of the configurations and more specific embodiments the squeezing jaws are preferably pressure-controlled, they may be provided with a displacement detector or a position detector.

By way of the squeezing pressure increased relative to the venting pressure in the settling stage, venting is supported such that the settling stage can be reduced.

A more specific embodiment of the invention provides for capturing during the filling process, in particular during filling or during the filling operation, in periodic intervals or continuously, a parameter for the weight of the package or for the feed material contained in the package. The weight may be determined by way of a net-weight or particularly preferably a gross-weight method. It is also possible for a bag chair, on which the package is placed, to be part of the weighing system. Since the weights of the parts involved are known, one can deduce the actual weight of the feed material contained in the package from the measured total weight.

As a package reaches its target weight, the material feed is preferably cut off. Also it is possible to employ weight-related control of the filling operation or the filling process wherein, as a predetermined weight or weight proportion is attained, the filling rate is reduced from the coarse filling rate to the slow filling rate. Or else, as a predetermined weight or weight proportion is attained, the filling rate may be continuously reduced down to a minimal filling rate to achieve optimal filling.

Reduction of the squeezing pressure at the end of the settling phase may in particular occur abruptly or approximately abruptly. In this way the available volume in the settling stage is made to greatly expand in a short time. What is also possible is a continuous volume expansion after attaining the predetermined, reduced volume.

In all of the other embodiments the volume available to the package can firstly be restricted preferably by side boundaries, squeezing devices, squeezing jaws or the like, which squeezing jaws or the like may then be displaced outwardly at the end of the filling process and in particular at the end of the settling stage to expand the available volume of the package. In preferred embodiments the boundary devices or squeezing jaws or the like may act on the longitudinal package sides. In particular the squeezing jaws are pressure-controlled, at least in the settling phase.

Also it is possible that the available volume in the settling phase is reduced as predetermined by means of a distance-controlled displacement of the squeezing jaws.

In preferred embodiments of the invention the volume available to the package is expanded up to 50% or more, in particular up to 30%. Preferably the volume expansion is between approximately 3% and 20% and particularly preferably between approximately 5% and 15%. Depending on the material to be filled the percentage may be still larger for particularly fluffy and lightweight materials.

It is preferred that after cutting off the filling element, the squeezing pressure is applied to the package, since the pressure decrease will occur more rapidly in the preceding time period with excess pressures being higher.

Where, near the end of the settling phase, the excess pressure in the bag is e.g. 100 millibars, the internal pressure will be approximately 1.1 bars. Expanding the volume by 10% allows to approximately entirely dissipate the excess pressure in the bag. According to the invention both the waiting time and the settling stage can be considerably shortened.

In all of the embodiments of the invention, a parameter for the internal bag pressure or the filling pressure in the package may be captured preferably by means of a pressure sensor. What is determined is in particular a parameter for the air pressure prevailing in the package.

For example, a filling element configured as a filling pipe or a filling spout may be provided with a probe having a measuring channel which reaches into the interior of the package to be filled such that a sensor connected with the measuring channel will capture a parameter for the pressure prevailing in the package. Other embodiments may provide that a parameter for the pressure prevailing in the package be deduced by means of a sensor connected with the filling element or with the package.

Advantageously the entire filling process or at least the filling operation is controlled in dependence on the parameter determined. This allows to maintain threshold values in the filling operation. Preferably the filling process is controlled such that a specified maximum pressure is not exceeded to avoid e.g. bag rupture. On the other hand the filling element is preferably controlled such that the pressure in the package or in the bag is as close as possible to the maximum pressure to accelerate the entire filling process.

Preferred specific embodiments of the invention provide that at least during a time period the volume available to the package varies in dependence on the parameter determined for the filling pressure prevailing in the package or the internal bag pressure.

In case that a pressure sensor is provided for determining a parameter for the internal bag pressure prevailing in the package, the time of discharging the package from the filling element or the filling spout may preferably be selected in dependence on the internal bag pressure to ensure that virtually no material will escape at discharge. To this end, the squeezing jaws can be opened and the internal bag pressure prevailing in the package, captured. When the discharge pressure is suitable, the bag may be discharged. Otherwise the squeezing pressure may be allowed to build up again until a suitable discharge pressure is present.

All of the embodiments in particular provide for the filling of valved bags which are closed after filling or else may be configured self-sealing.

All of the embodiments preferably employ a diaphragm pump for conveying the loose materials. Although diaphragm pumps are basically machines for conveying fluids, this system has also been tried and tested for conveying loose materials and in particular lightweight loose materials.

The functional principle of diaphragm pumps is similar to that of piston pumps wherein diaphragm pumps provide a complete separation between the bulk material to be filled and the drive. Separation is achieved by means of a diaphragm through which the moving, mechanical components of the motor are shielded from any interaction with the bulk material to be conveyed.

The actual mechanical drive of the diaphragm pump may be conventional by means of an electric motor through a con-rod or by way of appropriately controlled compressed air.

Diaphragm pumps offer the advantage over conveyor turbines that the filling capacity is less dependent on the excess pressure in the bag, such that the increased pressures prevailing during the filling operation have little impact on the quantities conveyed.

Preferably, twin diaphragm pumps are employed which may be pneumatically controlled. To this end, a twin housing is provided comprising a pair of diaphragms connected through a connecting rod. The external surfaces of the diaphragms are exposed to the bulk material to be conveyed and the internal surfaces, to compressed air. By way of the connecting rod, a valve is actuated which, as a final position is reached, directs the compressed air towards the other diaphragm. Such an air-controlled diaphragm pump transmits the air pressure directly to the bulk material to be conveyed. Throttling the pressure allows to readily adjust the quantity of the conveyed bulk material.

All of the embodiments are provided for filling in particular lightweight and optionally elastic bulk materials at a density below 300 kg per $m^3$ or at a density below 300 g per $dm^3$. What is preferably filled is bulk material at a density beneath 250 kg per $m^3$ and in particular of a density between 30 and 150 kg per $m^3$.

The apparatus according to the invention for filling flexible packages is in particular provided for filling bags with loose materials, comprising a control device and at least one filling element by means of which a package to be filled is filled in a filling process in particular while admitting air. The filling process comprises at least a filling stage, a settling stage for decreasing pressure, and a discharge stage. In the discharge stage the package can be discharged from the filling element. Therein, a squeezing device is provided by means of which external pressure can be applied on the package. The control device and the squeezing device are suitable and structured such that at least in the settling phase, the squeezing device applies an external squeezing pressure to the package so as to vent the package and to reduce the volume available to the package, until a detector device detects a predetermined reduction of the volume available to the package, whereupon a discharge signal is emitted, the squeezing pressure of the squeezing device on the package is reduced, and the package is discharged from the filling element.

The filling process can in particular be shortened in that by means of the squeezing or boundary device, the volume available to the package is reduced for a considerable part of the filling process and at the end of the settling stage it is greatly expanded to maintain a high pressure inside the package during the filling stage and to shorten the settling stage following the filling stage.

Preferably the squeezing device comprises a pair of squeezing jaws which can act on the sides of a package.

The detector device is in particular suitable to determine a value for the volume available to the package which determined value is preferably approximately proportional to the volume available to the package. The detector device comprises in particular at least one distance sensor or a position sensor or a displacement sensor. What is conceivable is e.g. an ultrasonic distance sensor or a laser distance sensor or another type of sensor suitable for capturing displacement or distances. In motor systems an incremental, angular displacement transducer is possible.

Preferred embodiments provide at least one pressure sensor by means of which a parameter for a pressure prevailing in the package can be determined. Preferably, a comparator device is provided to compare the prevailing pressure against a specified pressure and to emit a discharge signal as the prevailing pressure falls below the specified pressure.

All of the cases preferably provide at least one diaphragm pump for conveying the bulk material.

The apparatus according to the invention, which is in particular suitable for performing one of the methods described above, may in particular be used for efficiently filling valved bags wherein the predetermined reduction of volume after the filling stage allows efficient venting of the bags.

BRIEF DESCRIPTION OF THE DRAWINGS

Further advantages and applications of the invention follow from the embodiments which will now be described with reference to the attached Figures.

These show in:

FIG. 6 a front view of the bag chair according to FIG. 3 with a filled bag after squeezing;

FIG. 7 a schematic sectional view of a filling pipe of an apparatus according to the invention.

DETAILED DESCRIPTION OF THE INVENTION

Figure 1:
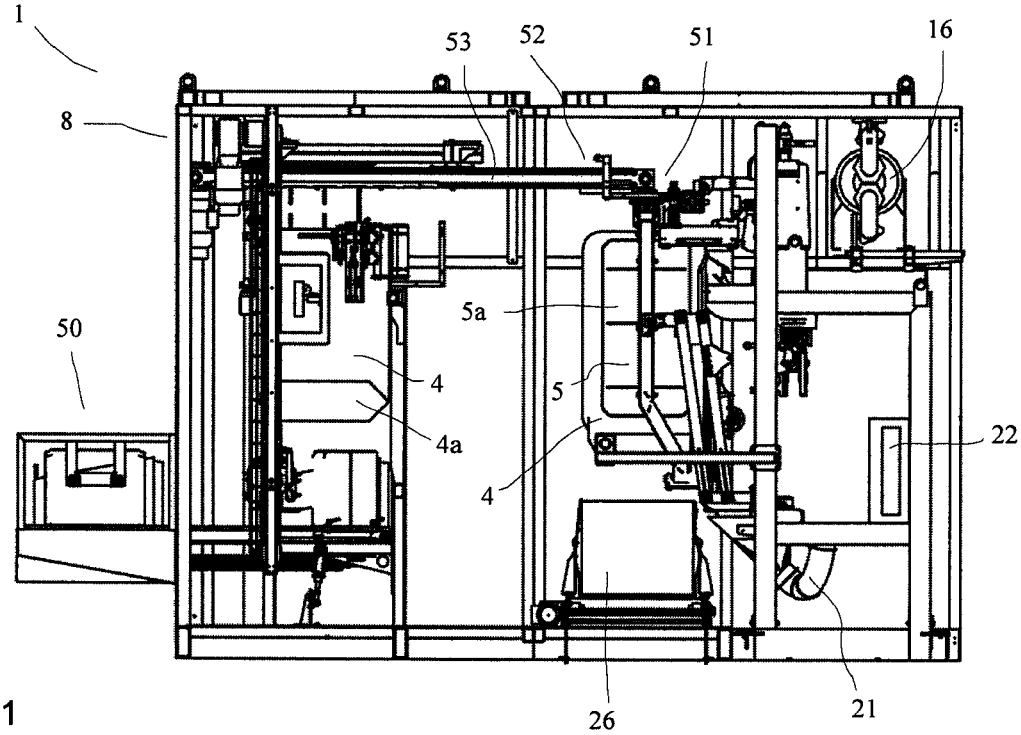
FIG. 1 a schematic illustration of an apparatus according to the invention.

With reference to the FIGS. 1 to 8, an embodiment of the invention will now be described. The inventive apparatus 1 illustrated in FIG. 1 is configured in the present exemplary embodiment as a packaging machine 1 with one single filling element in the shape of a filling pipe 3.

The packaging machine 1 serves to fill bags 4 with loose filling materials 18, being fully automatic in design in the present exemplary embodiment. It is conceivable to configure the packaging machine as a rotary system and to provide it with multiple filling elements distributed over the periphery. A manual placement is likewise conceivable.

The packaging machine 1 comprises a framework 8 and a filling element configured as a filling pipe 3 onto which the valved bags 4 having openings 25 are placed. An operating unit 22 serves for operating and for displaying the status of the packaging machine 1. A suction apparatus 21 draws off any material escaping e.g. during bag changes.

A supply of valved bags 4 is stored in an empty-bag magazine 50. For filling, a valved bag 4 is gripped and lifted. In FIG. 1 one can recognize the bag bottom 4*a* of an empty valved bag 4. The valved bag 4 is pushed onto the filling pipe 3 by means of the placement apparatus 51 (or by hand). To this end the travel unit 52 is displaced in the direction of the filling pipe 3.

After filling and discharging the valved bag 4, the valve is closed. It may for example be sealed. The bags 4 are thrown onto the discharge device 26. The actual weight of the valved bags 4 may be checked once more in the subsequent discharge line before the valved bags 4 are carried off.

As illustrated in FIG. 1, the filling pipe 3 is provided with a squeezing apparatus 5 associated therewith and comprising pairs of squeezing jaws 5*a* and 5*b*. For placement, the squeezing jaws 5*a* and 5*b* are moved apart such that the valved bag 4 can readily be pushed onto the filling pipe 3. Thereafter the squeezing jaws 5*a* and 5*b* are displaced to approach the valved bag from the sides such that the volume 60 available to the valved bag (see FIG. 4) is reduced virtually from the very start of the filling process, being smaller than the possible bag volume of the valved bag 4.

Figure 8:
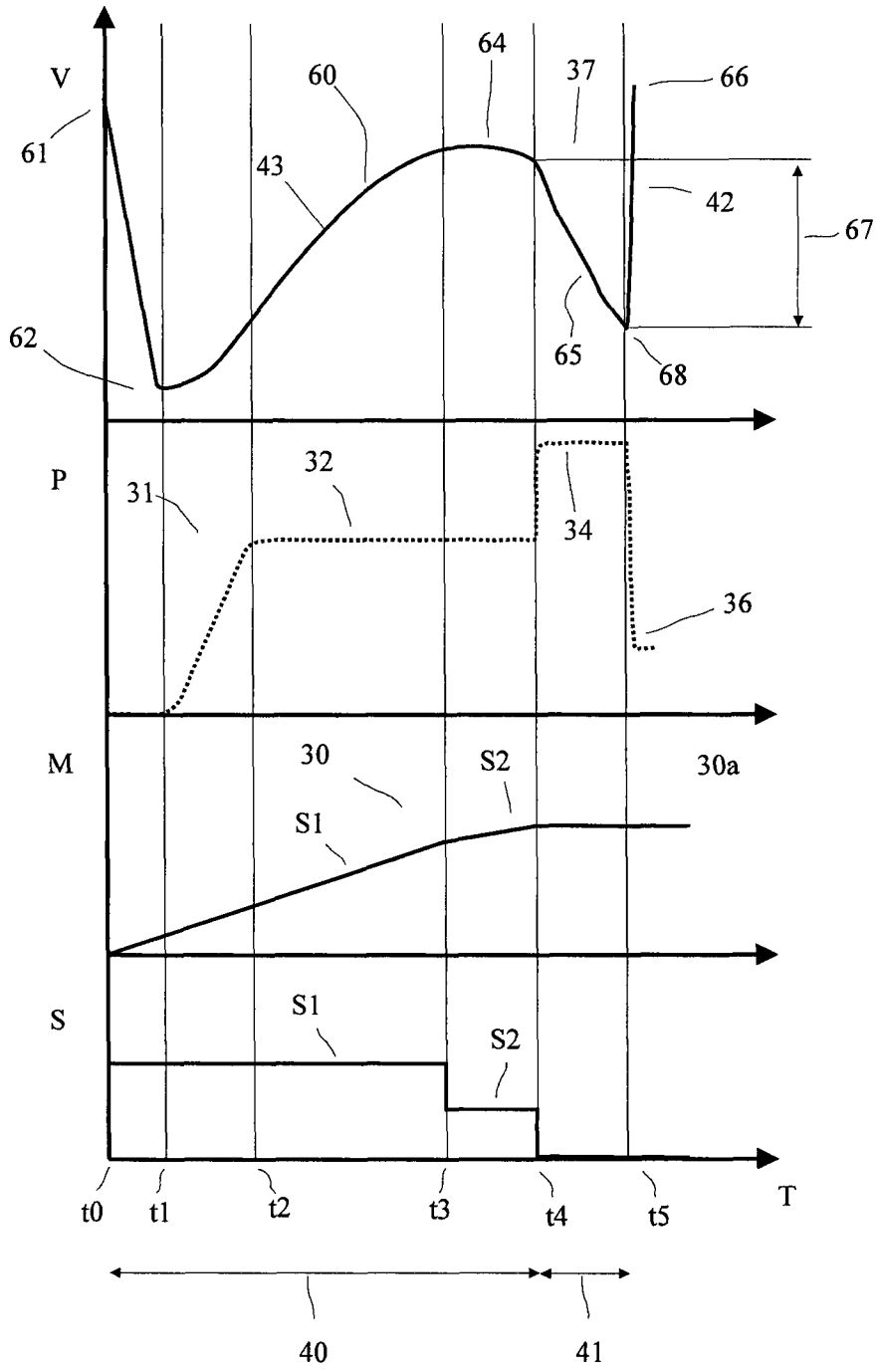
FIG. 8 a simplified, diagrammatic illustration of the filling status, filling weight, internal bag pressure, and of the volume available to the package over time during a filling process.

A very simplistic course, illustrated in principle only, of the bag weight 30 and the pressure 32 prevailing in the bag is plotted among other things in FIG. 8 over time T.

The time t0 marks the beginning of the filling stage 40. The empty bag 4 is in place and the squeezing jaws 5*a* and 5*b* are approached to their closest distance by way of the compressed air cylinder 6 such that the volume 60 available to the bag assumes its minimum value 62 at the time t1, starting from its initial volume 61. The filling operation starts concurrently, feed material 18 being filled in. The bag 4 expands due to the introduced feed material 18, assuming the available volume which, however, is initially restricted to the minimum volume 62 by means of the squeezing jaws 5*a* and 5*b*. Subsequently an excess pressure builds in the valved bag 4 of typically up to 100 or 250 millibars and which may be larger and depends on the feed material and the other conditions present. An approximately stationary state is achieved at the time t2. In particular the excess pressure 31 in the bag approximately corresponds to the externally applied venting pressure 32 of the squeezing jaws 5*a* and 5*b* in said filling stage 40.

Filling occurs by way of the coarse filling stream S1 until a predetermined weight is reached at the time t3. This is followed by the fine stream S2. At the time t4, the target weight 30*a* is reached, material feeding is stopped, and the filling stage 40 is terminated.

This is followed by the settling stage 41. At the time t4, the pressure applied externally by means of the squeezing jaws 5*a* and 5*b* is preferably directly increased to squeezing pressure 34. The squeezing pressure 34 of the squeezing jaws is preferably applied by means of the compressed-air cylinder 6. Consequently the pressure in the bag rises from pressure 32 to pressure 34 where it remains roughly constant. At the same time the valved bag 4 is vented with the bag volume 2 and the volume 60 available to the bag decreasing along the curve 65. The high internal pressure causes the bag 4 to vent rapidly and efficiently.

The volume available to the bag decreases until at the time t5 the available, predetermined volume 68 is obtained which may be specified as an absolute value, or else it ensues as a volume difference 67 from the volume at the time t4.

The detector device 70 senses the obtaining of the available, predetermined volume 68, emitting a signal which is then processed by the control device 14. The control device 14 emits a discharge signal and the discharge stage 42 is then initiated. The squeezing pressure 34 of the squeezing jaws 5*a*, 5*b* is reduced. The internal bag pressure which is still higher than the ambient pressure causes the squeezing jaws 5*a* and 5*b* to open up. In this way the volume 60 available to the valved bag 4 between the squeezing jaws 5*a* and 5*b* rapidly expands to volume 66.

Alternatively the squeezing jaws 5*a* and 5*b* may be actively opened by means of the cylinder 6 such that the available volume 60 expands to volume 66 quite abruptly or rather abruptly.

The valved bag 4 now assumes an expanded volume due to the excess pressure prevailing in the interior of the valved bag 4 by way of which the pressure prevailing in the interior of the valved bag 4 is correspondingly reduced. The result is presently that directly as the squeezing jaws 5*a* and 5*b* open, the internal bag pressure 31 equals the discharge pressure 36, such that the bag can be discharged virtually immediately after the time t5. The settling stage 41 is considerably shortened.

Due to the filling process, the waiting time required before the valved bag 4 can be discharged from the filling pipe 3 is considerably shortened such that the filling speed is higher than in conventional filling processes. At the same time, material is prevented from escaping at discharge from the filling pipe 3 because the internal pressure is reduced such that contamination of the valved bags 4, the packaging machine 1 and the surroundings is less or in particular absent. The filling process can be controlled such that as a rule no material or only extremely small quantities of material will escape from the valved bag 4.

The inventive packaging machine 1 is preferably employed for bagging lightweight materials and in particular aerosiles, carbon black, and other lightweight products. Or else it is conceivable to bag other materials such as cement or the like by means of the inventive packaging machine 1.

Experience in bagging lightweight filling materials such as pyrogenic silicic acid, has thus far revealed a noticeably increased output while at the same time improving weight accuracy. While in conventional machines the waiting time after terminating the filling operation until excess pressure in the bag was reduced as predetermined, was between approximately 15 and 20 seconds for a given feed material, the inventive system allows to discharge the bag soon after or immediately as the squeezing pressure has reduced the volume as specified and the volume available to the bag has expanded. Time saving in this example amounts to about 12 to 17 seconds per bag. Given an average duration of the filling operation of about 30 seconds, this means that the filling process will come down from 50 seconds to approximately 35 seconds, thus achieving a quite considerable increase of the system capacity of approximately 20 or 30 to 40%. In the case of heavier materials or materials admitting less air in bagging, the increase in output may be smaller.

Figure 2:
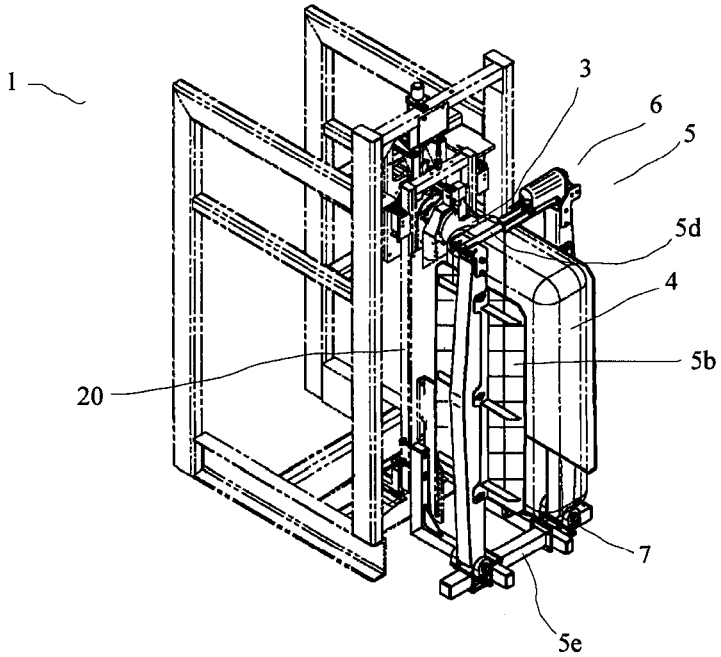
FIG. 2 a perspective view of another apparatus according to the invention.

FIG. 2 illustrates a perspective view of another embodiment of a packaging machine 1 according to the invention which is presently configured as a stationary machine and again as a non-rotary system. The bag chair 20 is part of the weighed system in the so-called gross weighing method wherein weighing includes the bag chair 20 and the squeezing device 5 and the valved bag 4 to be filled, to thus derive the quantity of the feed material 18 in the valved bag 4 from the determined weight (see FIG. 7), since the weights of the bag chair and the other involved components are known.

The squeezing device 5 in turn comprises a right squeezing jaw 5*a* and a left squeezing jaw 5*b* which in the initial position are disposed e.g. approximately in parallel and spaced apart and whose lower ends in the present case are pivotally supported on pivot axes 7. The two squeezing jaws 5*a* and 5*b* are interconnected at their top ends by way of a top bar linkage 5*d*, on which a drive 6 is disposed which is presently configured as a motor. Actuating the motor 6 causes the upper distance between the squeezing jaws 5*a* and 5*b* to be reduced so as to act on the volume 60 present between the squeezing jaws 5*a* and 5*b*, as can in particular be seen in the illustration of FIG. 4. The detector device visible in FIG. 6 which may be configured as a displacement sensor, may serve to control the squeezing jaws 5*a* and 5*b* on the basis of distances traveled. Alternatively, instead of the motor 6 a different actuator for actuating the squeezing jaws may be provided which may comprise e.g. a compressed-air cylinder or a hydraulic drive.

Instead of the rotatable mounting at the bottom ends of the squeezing jaws 5*a* and 5*b*, which are provided with a squeezing plate 5*c* each, the bottom linkage 5*e* may be configured to be adjustable in length by means of a compressed-air cylinder or a motor 6 or another kind of actuator.

By means of a length-adjustable linkage system 5*d* and 5*e*, a parallel displacement of the squeezing jaws 5*a* und 5*b* can be achieved.

According to the invention the squeezing jaws 5*a* and 5*b* of the bag chair 20 are approached to the valved bag 4 at the start of the filling process or the filling operation such that firstly, they considerably reduce the available bag volume 60 during filling by e.g. 30% or more. This means that, given a weight magnitude of e.g. 10 kg, only a reduced volume will be available. Now, as the valved bag has obtained its target weight and the filling operation is thus terminated, the internal pressure of the valved bag 4 will firstly be at a typical excess value of e.g. 100 or 250 millibars or the like.

At this point, the two squeezing jaws on the sides are approached toward one another at an increased squeezing pressure. In this way the venting rate increases while the bag volume decreases. The increased squeezing pressure will not be reduced until the volume available to the bag has been reduced as predetermined. For example the lateral squeezing jaws 5*a* and 5 can be displaced toward one another until a predetermined minimum distance is reached. Also it is conceivable to reduce the bag width by a predetermined amount of e.g. 2, 4, 6, or 8 cm. The predetermined amount may be made dependent on the product to be bagged and the bag dimensions. Only as the predetermined volume reduction has been reached will the squeezing pressure 34 be reduced or cut off, such that the volume available to the valved bag 4 quasi abruptly expands, thus compensating the excess pressure in the bag interior.

Therefore the valved bag 4 can as a rule be discharged as the squeezing jaws 5*a* and 5*b* have been moved apart, without incurring a detrimental material loss at discharge. Consequently this system allows improved bagging capacity since the waiting period after filling is minimal while no feed material 18 or only negligible amounts will escape at discharge.

Figure 3:
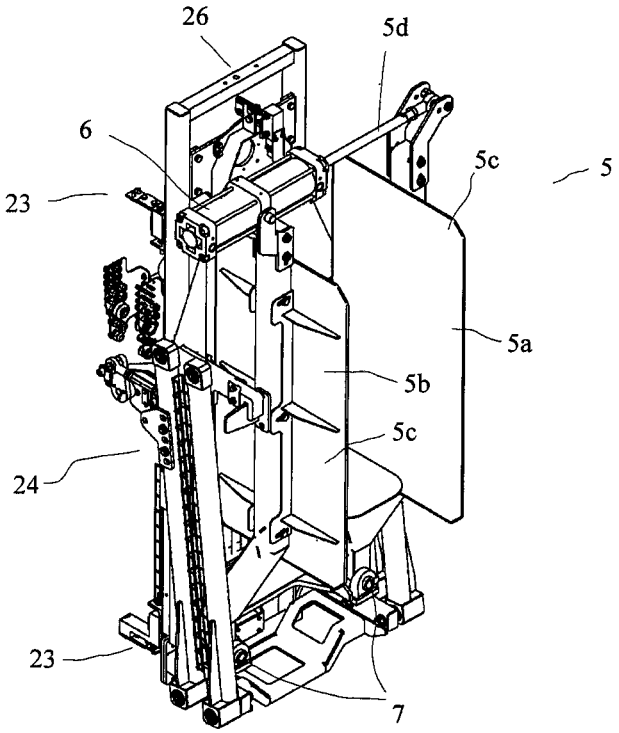
FIG. 3 a perspective view of a bag chair for an apparatus according to FIG. 1 or 2.

Or else it is conceivable for the squeezing jaws 5*a* and 5*b* to be first opened and then slightly pressed against the bag 4 again after termination of the filling operation to thus assist in the bag discharge by means of the bag discharge device 24 (see FIG. 3). In the embodiment illustrated in FIG. 3 the bag chair 20 including the squeezing apparatus 5 and the bag discharge device 24 are part of the weighed system which is weighed during filling to thus determine the filled product weight and to correspondingly control the filling operation. The bag chair 20 is suspended on the framework 8 by way of the counterguide links 23 and is weighed by way of the measuring box (not shown) mounted on the measuring box fixture 26.

In preferred embodiments the packaging machine comprises a twin diaphragm pump 16 for conveying the feed material 18. A twin diaphragm pump 16 is particularly suitable for bagging lightweight feed materials 18. The filling capacity in the case of feed materials at a bulk weight beneath 100 g per $dm^3$ is approximately 60 bags per hour and filling spout, although it may be above or beneath said value.

Reference is made at this point that according to the invention not only stand-alone or multi-unit packaging machines may be provided but there may be employed, rotary packaging machine having more than one filling pipe or multi-unit packaging machines having multiple filling pipes in series.

The filling process provides that the filling operation be controlled by means of weighing control which controls the filling rate in dependence on the filled weight already present in the valved bag 4.

Figure 4:
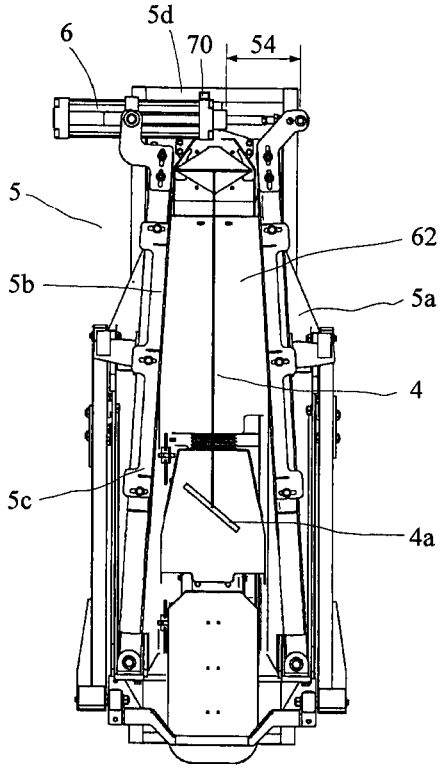
FIG. 4 a front view of the bag chair according to FIG. 3 with an empty bag placed on it.

FIG. 4 illustrates a front view of a bag chair 20 with an empty bag 4 in place. The available volume 60 is reduced to minimum volume 62 since the squeezing jaws 5*a* and 5*b* are retracted. The distance 54 at the cylinder 6 is a measure of the available bag volume. The distance 54 is correspondingly small in the condition illustrated in FIG. 4 since the available volume was reduced to the minimum volume 62. The bag volume 2 is presently nearly zero because no feed material 18 has yet been filled into the bag 4. As filling begins, the actual bag volume 2 rapidly reaches the available volume 62, whereupon the internal bag pressure 31 increases until it reaches the venting pressure of the squeezing jaws 5*a* and 5*b*. As filling progresses, the squeezing jaws 5*a* and 5*b* are urged apart and the available volume 60 and the bag volume 2 increase until the specified end weight 30*a* is reached.

Figure 5:
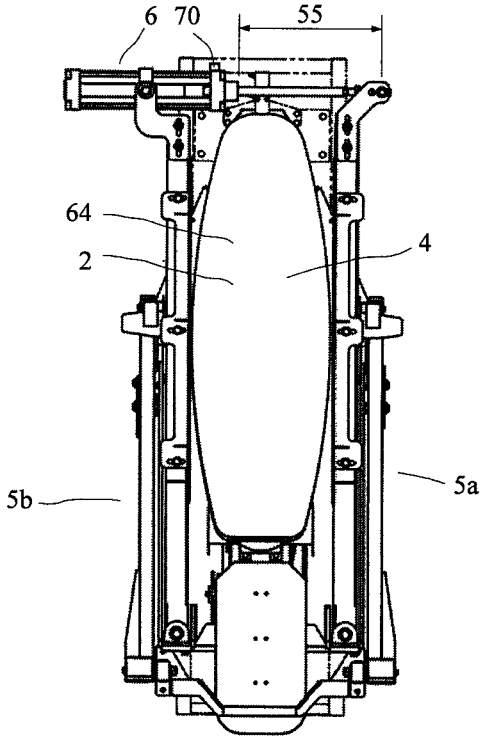
FIG. 5 a front view of the bag chair according to FIG. 3 with a filled bag after cutting off the conveyor feed.

FIG. 5 shows the filled condition in which the available volume 64 reaches approximately its intermediate maximum. In relation to feed material and filling conditions, the bag volume is at its maximum presently or somewhat earlier during filling by way of the fine stream S2.

Subsequently the squeezing jaws are urged against the side surfaces of the bag 4 at excess squeezing pressure 34 wherein the bag 4 will vent rapidly due to the high squeezing pressure 34. The actual bag volume decreases until the available volume 60 has been reduced as predetermined, either reduced by a predetermined amount 67 or a proportion, or else reaches a predetermined, available volume 68. This state is shown in FIG. 6. The distance 56 is clearly smaller than distance 55 in the engorged state which is shown in FIG. 5.

The present distances 54 to 56 are approximately proportional to the available volume 60. The actual, existing distance is captured by the detector device 70 which operates as a travel, distance, or length measuring device, detecting a measure for the distance of the two squeezing jaws 5*a* and 5*b*. Thereupon, squeezing is terminated and discharge of the bag 4 initiated.

Termination of squeezing is presently initiated as the distance 56 has been reached which represents a specific, available volume 68. Other embodiments may provide a laser or ultrasonic distance sensor or another type of travel or length sensor.

FIG. 7 illustrates a schematic cross-section through a filling pipe 3. In this filling pipe 3 at least one additional pressure sensor 10 is provided by means of which a parameter for the pressure prevailing in the valved bag 4 can be captured.

FIG. 7 is a sectional view of the filling pipe 3 onto which a valved bag 4 is pushed by way of its opening 25. The valved bag 4 is retained and sealed against the environment by means of a swelling collar 27 attached to an external surface 3*a* of the filling pipe 3. When swollen, the swelling collar 27 bears against an internal wall 28*b* of a portion 28 of the valved bag 4 which serves to attach the valved bag 4 to the filling pipe 3.

By means of the squeezing device according to the FIGS. 3 to 6 the volume 60 available to the valved bag 4 is already reduced before the filling stage is started.

Furthermore, during the filling process the pressure sensor 10 captures a value characteristic of the pressure in the valved bag 4. Said pressure sensor 10 may be disposed in an area 3*c* of the filling pipe 3 immediately adjacent to an area 3*d* covered by the portion 28 of the valved bag 4. The pressure sensor 10 penetrates a wall of the filling pipe 3 to thus capture the pressure in the interior of the filling pipe 3 which substantially corresponds to the pressure prevailing in the valved bag.

Alternatively, a pressure sensor 10 may be provided to capture the pressure prevailing in the interior of the bag by means of a pressure sensing aperture 9 or a measuring channel or a measuring line 13. The pressure sensing aperture 9 may e.g. be provided in a forwardly region of the filling pipe 3 adjacent to the outlet opening for the feed material 18. The measuring line 13 may comprise a first portion 13*a* in the filling pipe configured as a channel and a second portion 13*b* configured as a flexible or rigid line and connected with the pressure sensor 10. Since pressure disorders spread at sonic speed, the measuring line 13 may have a considerable length.

The pressure data captured by the pressure sensor 10 are put in intermediate storage in the associated digital evaluation unit 11 and transmitted to a central control unit 14. The filling process is controlled by way of the data measured by means of the weighing system 12 and by means of the pressure sensor 10. The measured values measured by the weighing device 12 are transmitted to an electronic processing unit 15 which is connected with the central control unit 14 which in turn controls the conveyor element 16.

For specific materials or in particular situations, air may be fed through an air supply 17 to loosen e.g. caked layers.

The filling process operates as follows: After placing a valved bag 4 on a filling pipe 3 by hand or by means of an automatic placement unit, the valved bag 4 is retained by means of the swelling collar 27, and the squeezing jaws 5*a* and 5*b* are approached to the bag to restrict the volume available to said bag. Thereafter the filling operation is started, controlled by the electronic control unit 14 and wherein the feed material 18 and a quantity of air 19 are introduced into the bag 4 at the same time.

The feed material 18 fed to the conveyor element 16 from a storage bunker or the like, is introduced into the valved bag 4 through the filling pipe 3. The quantity of the introduced material 18 is continuously captured by the weighing device 12, which is shown only schematically, and the measured values are transmitted to the processing unit 15 and the control unit 14.

The pressure prevailing in the valved bag 4 can be captured concurrently. When the internal pressure in the valved bag exceeds a predetermined level, the filling operation is decelerated to keep the valved bag 4 from rupturing. Reversely, the filling rate may be increased if the pressure prevailing in the valved bag is below a predetermined level.

The positions of the squeezing jaws may be controlled in dependence on the current weight and the pressure determined in the valved bag 4. It is e.g. conceivable for the squeezing jaws 5*a* and 5*b* to reduce the volume available to the bag only as a predetermined percentage of e.g. 30 or 50% of the target filling volume has been filled into the bag. Or else it is conceivable that after termination of the filling operation the squeezing jaws 5*a* and 5*b* continuously approach one another to continuously reduce the volume available to the bag, before the bag volume is ultimately expanded before discharge.

The squeezing jaws are preferably moved away from each other after squeezing is terminated such that the pressure in the bag interior drops rapidly or even quasi abruptly. Now when the excess pressure determined in the bag interior falls beneath a predetermined or selected value, the bag is discharged. Since no or only a slight excess pressure is present at discharge, only very little or no feed material 18 escapes out of the bag at discharge, such that the bags 4 and the packaging machine 1 remain considerably cleaner. The pressure sensor 10 allows to check the interior bag pressure 31 before discharge to positively prevent any feed material 18 from escaping at discharge.

LIST OF REFERENCE NUMBERS

1 packaging machine
2 volume
3 filling pipe
3*a* external surface
3*d* area
4 valved bag
4*a* bag bottom
5 squeezing apparatus
5*a*, 5*b* squeezing jaw
5*c* squeezing plate
5*d*, 5*e* linkage
6 compressed-air cylinder
7 pivot axis
8 framework
9 pressure sensing aperture
10 pressure sensor
11 evaluation unit
12 weighing system
13 measuring line
13*a*,13*b* portion
14 control unit
15 processing unit
16 twin diaphragm pump
16 conveyor element
17 air feed
18 feed material
19 air content
20 bag chair
21 suction apparatus
22 operating unit
23 counterguide
24 bag discharge device
25 opening
26 measuring box fixture
27 swelling collar
28 portion
28*b* internal wall
30 bag weight
30*a* bag weight
31 internal bag pressure
32 venting pressure
34 squeezing pressure
36 discharge pressure
37 settling phase
40 filling stage
41 settling stage
50 empty-bag magazine
51 placement apparatus
52 travel unit

53 travel rail
54-56 distance
60 volume
61 initial volume
62 minimum volume
63 intermediate maximum
64 curve
65 predetermined volume
66 final volume
67 volume difference
68 minimum volume
70 detector device
t1-t5 time
S1 coarse stream
S2 fine stream

The invention claimed is:

1. A method for filling valved bags (4) with loose materials (18), wherein by means of a filling element (3) a valved bag (4) to be filled is filled by means of a filling process, which filling process comprises at least a filling stage (40), a settling stage (41) and a discharge stage (42), wherein during the filling stage (40) at least one loose material (18) is filled into the valved bag (4) and during the settling stage (41) at least one settling phase (37) for venting is provided, and wherein during the discharge stage (42) the valved bag (4) is discharged from the filling element (3), wherein during the filling stage the material is filled by way of a coarse filling stream followed by way of a fine filling stream and wherein the filling by way of coarse filling stream occurs until a predetermined weight is reached and the filling by way of fine filling stream occurs until a target weight is reached and the feeding of material is terminated, characterized in that during the filling by way of fine filling stream and at least during a majority of time during the filling by way of coarse filling stream at least one squeezing device (5) externally applies a venting pressure (32) to the valved bag (4) so as to reduce the volume (60) available to the valved bag (4) and at least in the settling phase (37) the at least one squeezing device (5) applies a squeezing pressure to the valved bag (4) for venting the valved bag (4) and reducing the volume (60) available to the valved bag (4), until a predetermined reduction of the volume available to the valved bag (4) is achieved, whereupon the squeezing pressure (34) of the squeezing device (5) on the valved bag (4) is reduced and the valved bag (4) is discharged from the filling element (3) and wherein a parameter for the weight of the valved bag (4) is captured during the filling stage (40) and as the target weight (30*a*) of the valved bag (4) is reached, feeding of the material is cut off.

2. The method according to claim 1, wherein at least one detector device (70) captures a value for the volume (60) available to the valved bag (4) and emits a discharge signal when a predetermined reduction is achieved, whereupon the squeezing pressure on the valved bag (4) is reduced and the valved bag (4) is discharged.

3. The method according to claim 1, wherein a detector device (70) captures a value approximately proportional to the volume (60) available to the valved bag (4).

4. The method according to claim 1, wherein the predetermined reduction is achieved when in the settling phase (37) the volume (2) available to the valved bag (4) is reduced to or by a predetermined measure.

5. The method according to claim 1 wherein during the filling stage (40) a specified venting pressure (32) is rapidly built up in the valved bag (4) and subsequently roughly maintained.

6. The method according to claim 1 wherein the volume (60) in the settling stage (41) is greatly expanded in one step.

7. The method according to claim 1, wherein external pressure is applied to the valved bag (4) by means of squeezing jaws (5*a*, 5*b*) of a squeezing device (5) which act in particular on the longitudinal sides of the valved bag (4).

8. The method according to claim 7, wherein the squeezing jaws (5*a*, 5*b*) are pressure-controlled at least in the settling phase (37).

9. The method according to claim 7, wherein the available volume in the settling phase (37) is reduced as predetermined by means of a distance-controlled displacement of the squeezing jaws (5*a*, 5*b*).

10. The method according to claim 1, wherein a pressure sensor (10) captures a parameter for the internal bag pressure (31) in the valved bag (4) and the filling process is controlled at least in part in dependence on the internal bag pressure (31).

11. The method according to claim 1, wherein the discharge time (t3) is selected in dependence on the internal bag pressure (31).

12. The method according to claim 10, wherein after reduction of the squeezing pressure (34) the internal bag pressure (31) in the valved bag (4) is checked and as it falls beneath a specified discharge pressure (36) the discharge time (t3) is selected.

13. The method according to claim 1, wherein a diaphragm pump (16) is employed for conveying the loose materials (18).

14. The method according to claim 1, wherein squeezing jaws (5*a*, 5*b*) apply a slight pressure on the valved bag (4) at discharge of the valved bag (4) to assist in discharge.

15. An apparatus for filling valved bags (4) with loose materials (18), comprising a control device (14) and at least one filling element (3) for filling a valved bag (4) to be filled by means of a filling process, which filling process comprises at least a filling stage (40) for filling the valved bag (4), a settling stage (41) with at least one settling phase (37) for venting and a discharge stage (42), and wherein in the discharge stage (42) the valved bag (4) can be discharged from the filling element (3), wherein during the filling stage the material is filled by way of a coarse filling stream followed by way of a fine filling stream and wherein the filling by way of coarse filling stream occurs until a predetermined weight is reached and the filling by way of fine filling stream occurs until a target weight is reached and the feeding of material is terminated, characterized in that during the filling by way of fine filling stream and at least during a majority of time during the filling by way of coarse filling stream a squeezing device (5) is provided which can apply external pressure on the valved bag (4), characterized in that the control device (14) and the squeezing device (5) are suitable and structured such that at least during part of the filling stage (40) they externally apply a venting pressure (32) to the valved bag (4) so as to reduce the volume (60) available to the valved bag (4) and at least in the settling phase (37) they apply an external squeezing pressure (34) to the valved bag (4) by means of the squeezing device (5) for venting the valved bag (4) and reducing the volume (60) available to the valved bag (4), until a detector device (70) detects a predetermined reduction of the volume available to the valved bag (4), whereupon a discharge signal is emitted, the squeezing pressure (34) of the squeezing device (5) on the valved bag (4) is reduced and the valved bag (4) is discharged from the filling element (3), and wherein a parameter for the weight of the valved bag (4) is captured during the filling stage (40) and as the target weight (30*a*) of the valved bag (4) is reached, feeding of the material is cut off.

16. The apparatus according to claim 15 wherein the squeezing device (5) comprises a pair of squeezing jaws (5*a*, 5*b*) which can act on areas on the sides of a valved bag (4) disposed on the filling element (3).

17. The apparatus according to claim 15, wherein the detector device (70) is suitable to determine a value for the volume (60) available to the valved bag (4) which determined value is approximately proportional to the volume (60) available to the valved bag (4).

18. The apparatus according to claim 15, wherein the detector device (70) comprises at least one distance or displacement sensor.

19. The apparatus according to claim 15, wherein at least one pressure sensor (10) is provided, by means of which a parameter for a pressure prevailing in the valved bag (4) can be determined and wherein a comparator device (14) is provided which compares the prevailing pressure (31) against a specified discharge pressure (36) and which triggers a discharge signal when the prevailing pressure (31) is beneath the specified discharge pressure (36).

20. The apparatus according to claim 15, wherein at least one diaphragm pump (16) is provided for conveying the bulk material (18).

* * * * *